United States Patent [19]

Yamaguchi et al.

[11] Patent Number: 4,909,485

[45] Date of Patent: Mar. 20, 1990

[54] APPARATUS FOR CONTINUOUSLY ANNEALING METAL STRIP AND HEARTH ROLL THEREFOR

[75] Inventors: Yasuhiro Yamaguchi; Yuji Shimoyama; Tteo Ohnishi; Satoshi Kasai; Hironobu Ohno; Hisao Yasunaga, all of Chiba, Japan

[73] Assignee: Kawasaki Steel Corp., Japan

[21] Appl. No.: 358,477

[22] Filed: May 30, 1989

Related U.S. Application Data

[63] Continuation of Ser. No. 92,455, Sep. 3, 1987, abandoned.

[30] Foreign Application Priority Data

Sep. 5, 1986 [JP] Japan ..... 61-209139
Sep. 5, 1986 [JP] Japan ..... 61-209140

[51] Int. Cl.[4] ..... C21D 9/56

[52] U.S. Cl. ..... 266/103; 29/121.8; 29/132; 226/193; 266/274; 432/246

[58] Field of Search ..... 266/102, 103, 274, 287; 432/236, 246; 226/190, 193; 29/121.8, 132

[56] References Cited

U.S. PATENT DOCUMENTS 2,984,473 5/1961 Ornitz et al. ..... 432/246
4,433,032 2/1984 Nakamura et al. ..... 428/682
4,470,802 9/1984 Zaizen et al. ..... 432/2
4,484,959 11/1984 Boucher et al. ..... 29/132

FOREIGN PATENT DOCUMENTS 0030614 6/1981 European Pat. Off. .
0090428 10/1983 European Pat. Off. .
0091292 10/1983 European Pat. Off. .

OTHER PUBLICATIONS

Metals Handbook, vol. 5, pp. 170–171, ©1982.
Patent Abstracts of Japan, vol. 7, No. 259, (C-195), 11/18/83, and JP-A-58 141 338, 8/22/83.
Transactions ISIJ, vol. 26, No. 9, Sep., 1986, p. 843, Tokyo, Japan; "Application of Cr-C Cermet Coating to Hearth Roll in Continuous Annealing Furnace".
Patent Abstracts of Japan, vol. 8, No. 172 (C-237), 11/9/84 JPA 59-70712, 4/21/84.
Patent Abstracts of Japan, vol. 5, No. 136, (C-69), 8/28/81 and JP-A 56-69321, 6/10/81.
Patent Abstracts of Japan, vol. 7, No. 175 (C-179), 8/3/83 and JP-A 58 81918, 5/17/83.

*Primary Examiner*—Robert McDowell
*Attorney, Agent, or Firm*—Austin R. Miller

[57] ABSTRACT

An improved layout of the hearth rolls in an annealing furnace comprises a plurality of ceramic coated rolls and a plated rolls. The ceramic coated rolls are arranged in a region in the annealing furnace, where the temperature is higher than 450° C. On the other hand, the plated rolls are arranged in a region where the temperature is lower than or equal to 450° C. The hearth roll is provided a wear resistant coating of chrome plate or sprayed on ceramic of a thickness greater than or equal to 1 μm and less than or equal to 100 μm. In addition, according to the invention, the hearth roll is provided a surface roughness Ra in the range of 4.5 μm to 20 μm.

14 Claims, 3 Drawing Sheets

APPARATUS FOR CONTINUOUSLY ANNEALING METAL STRIP AND HEARTH ROLL THEREFOR

This application is a continuation of application Ser. No. 092,455, filed 9/3/87, now abandoned.

BACKGROUND OF THE INVENTION

1. Field of the Invention

The present invention relates generally to a method and apparatus for continuously annealing a metal strip. More specifically, the invention relates to an improved hearth roll arrangement for an annealing furnace. The present invention also relates to a hearth roll for the improved annealing furnace.

2. Description of the Background Art

As is well known, a plurality of hearth rolls are arranged in a heat treatment furnace such as annealing furnace at vertically offset positions for defining a zigzag path for a metal strip. The metal strip is fed through the path at a given speed and heated at a predetermined heat cycle. Usually, the metal strip is fed through the metal strip path thus defined, at such a high speed that the LSD value (line speed (mpm)×strip thickness (mm)) is greater than or equal to 150 (mpm.mm). Such high speed feed of the metal strip tends to cause slippage between the hearth roll and the metal strip resulting in meandering of the strip. Meandering of the metal strip is apt to cause breakage, cracking or so forth of the strip.

In order to prevent slipping between the hearth roll and the metal strip, the peripheral surface of the hearth roll, which contacts the surface of the metal strip, is treated to have a predetermined roughness. In order to maintain sufficient grip between the hearth roll peripheral surface and the metal strip surface and thereby prevent slippage therebetween, the peripheral surface of the hearth roll should be provided satisfactory wear resistance. Therefore, wear-resistant surface treatment has to be performed on the peripheral surface of the hearth roll. Conventionally, this surface treatment has been performed by spray coating of ceramics, such as chromium carbide, tungsten carbide. Hearth rolls having a ceramic layer formed thereon by spray coating will be hereafter referred to as "ceramic coated roll" throughout the disclosure.

Such ceramic coated roll exhibits a satisfactorily high wear resistance and heat resistance for use in an annealing furnace. On the other hand, such ceramic coated rolls have some drawbacks. For example, it is difficult to maintain a consistant surface roughness on the ceramic coated roll and fluctuation of the roughness on the peripheral surface of the hearth roll tends to occur. Another drawback of the ceramic coated roll is the relatively high possibility of adherence of welding slag or oxidation scale on the coated surface. Such adherence tends to form impressions on the metal strip to be treated. Furthermore, such ceramic coated rolls are rather expensive in comparison with plated rolls, such as a chrome plated roll. Rolls whose peripheral surface is plated, such as with chrome plating, will be hereafter referred to as "plated roll" throughout the disclosure.

Such plated rolls, especially the chrome plated rolls have been considered as not applicable for the annealing furnace due to softening at high temperature. That is, in the case of the chrome plated roll, the hardness of the chrome plating layer drops significantly when the temperature increases above 450° C. On the other hand, at temperatures lower than 450° C., such a chrome plating layer exhibits hardness equivalent to that of the ceramic layer on ceramic coated rolls. In addition, it is easier to control the surface roughness of plated rolls than ceramic coated rolls.

SUMMARY OF THE INVENTION

Therefore, it is an object of the invention to provide an improved hearth roll arrangement for an annealing furnace, which solves the problems in the conventional art.

Another an more specific object of the invention is to provide an improved layout for the hearth rolls in an annealing furnace, which allows plated rolls to be employed without causing their plating to become soft.

A further object of the invention is to provide a hearth roll which can be employed in the improved arrangement of the hearth rolls according to the invention.

In order to accomplish the aforementioned and other objects and advantages, an improved layout of the hearth rolls in an annealing furnace, according to the invention, comprises a plurality of ceramic coated rolls and plated rolls. The ceramic coated rolls are arranged in a region in the annealing furnace, where the temperature is higher than 450° C. On the other hand, the plated rolls are arranged in a region where the temperature is lower than or equal to 450° C.

In order to accomplish another object, the hearth roll is treated to have a surface coating layer, i.e. a spray coated layer or plating layer of a thickness greater than or equal to 1 μm and smaller than or equal to 100 μm. In addition, the hearth roll, according to the invention, is provided a surface roughness Ra in the range of 4.5 μm to 20 μm.

According to one aspect of the invention, a furnace for heat treatment of a metal strip comprises a metal strip path defined within the furnace and extending through a first zone in which a temperature of the metal strip is lower than or equal to a predetermined temperature, a second zone in which a temperature of the metal strip is higher than the predetermined temperature, a plurality of first hearth rolls disposed along the metal strip path within the first zone, each of the first hearth rolls having its peripheral surface plated with wear-resistant material, and a plurality of second hearth rolls disposed along the metal strip path within its the second zone, each of the second hearth rolls having its peripheral surface treated by spray coating with a wear-resistant material.

According to another aspect of the invention, an annealing furnace for continuously annealing a metal strip comprises a metal strip path defined within the furnace and extending through a first zone in which a temperature of the metal strip is lower than or equal to a predetermined temperature, a second zone in which a temperature of the metal strip is lower than or equal to a predetermined temperature, a second zone in which a temperature of the metal strip is higher than the predetermined temperature, a plurality of first hearth rolls disposed within the first zone, each of the first hearth rolls having its peripheral surface plated with wear-resistant material, and a plurality of second hearth rolls disposed within the second zone, each of second hearth rolls having its peripheral surface provided, by spray coating, with a wear-resistant material.

The predetermined temperature may be determined in relation to the wear-resistant material on the roll surface of the first hearth roll, so that the predetermined temperature is set at a temperature above or below which hardness of the plating layer varies significantly. In practice, the wear-resistant material forming the plating layer is chrome and the predetermined temperature is set at 450° C.

The preferred embodiment of the annealing furnace is designed to feed the metal strip at such a line speed that a product of the line speed and a thickness of the metal strip is greater than 100 (mpm.mm).

In practice, the metal strip path extends through a heating zone, a soaking zone, a first cooling zone, a second cooling zone and a third cooling zone, in which the section immediately adjacent the entrance of the heating zone, the downstream half of the second cooling zone and the third cooling zone constitute the first zone in which the first hearth rolls are disposed. The heating cycle in the first and second cooling zones is variable depending upon the metal strip to be treated.

According to another aspect of the invention, the surface of the hearth roll employed in the aforementioned heat treatment furnace or annealing furnace for continuous annealing of metal strip, has a predetermined roughness before being coated and has a wear-resistant surface coating of a thickness which will cause its surface roughness to have an Ra value in the range of 4.5 μm to 20 μm.

The coating layer has a thickness thicker than or equal to 1 μm and thinner than or equal to 100 μm. In practice, the coating layer is a spray coated ceramic or chrome plating.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment, but are for explanation and understanding only.

In the drawings.

DESCRIPTION OF THE PREFERRED EMBODIMENT

Figure 1:
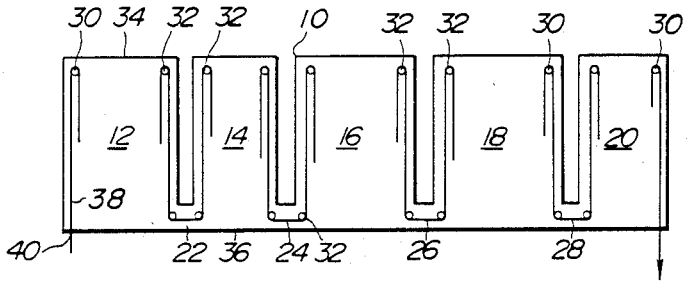
FIG. 1 is a diagrammatical illustration showing the preferred embodiment of an annealing furnace according to the invention.
Figure 2:
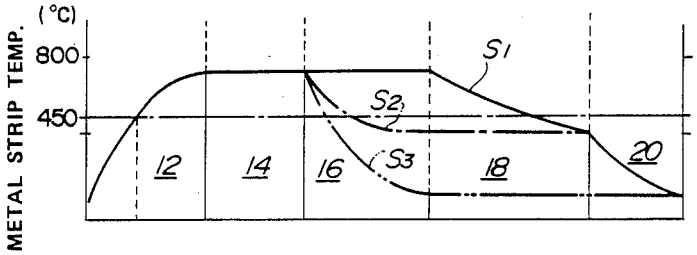
FIG. 2 is a chart showing temperature distribution in the annealing furnace of FIG. 1.

Referring now to the drawings, particularly to FIGS. 1 and 2, a continuous annealing furnace 10 has a plurality of zones for performing heat treatment or annealing operation therein. In the shown embodiment, the layout of the annealing furnace 10 includes a heating zone 12, a soaking zone 14, a first cooling zone 16, a second cooling zone 18 and a third cooling zone 20. Each zone 12, 14, 16, 18 and 20 is communicated with the adjacent zones, i.e. the leading zone and following zone via communication paths 22, 24, 26 and 28. A plurality of hearth rolls 30 and 32 are arranged in the respective zones 12, 14, 16, 18 and 20 in the annealing furnace. As is well known, half of the hearth rolls 30 and 32 are arranged upper section of respective furnace chambers in respective zones 12, 14, 16, 18 and 20 adjacent the ceiling 34 of the furnace. The half of the hearth rolls 30 and 32 are arranged lower sections of respective zones 12, 14, 16, 18 and 20 adjacent the floor 36 of the furnace. The hearth rolls 30 and 32 arranged at the upper section in the furnace chambers will be hereafter referred to as "upper hearth rolls" and the hearth roll arranged at the lower sections of the furnace chambers will be hereafter referred to as "lower hearth rolls". The upper and lower hearth rolls 30 and 32 are so arranged as to span several tens of meters. The upper and lower hearth rolls are so arranged as to define a zig-zag path for a continuous metal strip 38. The metal strip 38 is fed into the annealing furnace via an inlet 40 and alternatively wound around upper and lower hearth rolls 30 and 32 along the zig-zag path in a per se well known manner. The metal strip 38 in the furnace is fed at a line speed (mpm) selected to have a LSD value (line speed × metal strip thickness) greater than equal to 100 (mpm.mm).

As is well known, the metal strip 38 is fed, at first, into the heating zone 12 via a roll seal (not shown) provided at the inlet to be heated in the reductive atmosphere in the furnace chamber. A radiant tube burner or other heating device is provided in the heating zone heating the furnace chamber.

Another radiant tube burner or other heating device is also provided in the soaking zone 14 for evenly maintaining a section of the metal strip 38 at a predetermined temperature, as shown in FIG. 2. In practice, the metal strip 38 is brought near the predetermined temperature in the heating zone 12. Therefore, the heating device in the soaking zone may merely provide enough heat to prevent temperature drop in the metal strip due to radiation of heat. A radiant tube burner or other heating device is also provided in the first cooling zone 16 for adjusting the pattern of cooling of the metal strip according to the material to be processed and/or the product to be produced.

In order to adapt the heating cycle in the furnace, the respective heating devices in the heating zone 12, the soaking zone 14 and the first cooling zone 16 are designed to be controlled according to the desired patterns of heat cycles. For example, as shown in FIG. 2, cooling patterns in the first cooling zone can be adjusted by adjusting the amount of heat provided by means of the heating device therein.

In the shown example of FIG. 2, the line $S_1$ represents cooling mode pattern for high-temper in plate, and electromagnetic steel plate. As will be seen from FIG. 2, in this cooling mode pattern, the metal strip is maintained at substantially the same temperature in the soaking zone 14. The line $S_2$ in FIG. 2 shows cooling pattern applicable for soft-temper tin plate or cold rolled plate which requires over-aging heat treatment. The line $S_3$ of FIG. 2 shows a cooling pattern applicable for high-tension steel plate. In the third case, the metal strip 38 is rapidly cooled to 300° C. When the metal strip to be treated requires relatively rapid cooling, such as that to be treated by the $S_2$ and $S_3$ cooling mode pattern, a cooling gas is discharged toward the strip via gas jets (not shown) arranged at both sides of the metal strip path in the first cooling zone 16.

A cooling tube and electric heater may be provided in the second cooling zone for adjusting the cooling pattern according to the kind of metal strip to be treated. As seen from FIG. 2, when the metal strip is to be treated by the cooling mode pattern of $S_1$, the metal strip is gradually cooled in essentially linear fashion to approximately 450° C. in the second cooling zone 18. On the other hand, a metal strip treated by the cooling mode patterns of $S_2$ and $S_3$ is rather rapidly cooled in the first cooling zone 16 is fairly evenly maintained in the second cooling zone 18 at substantially the same temperature as that in the outlet of the first cooling zone 16.

Gas jets are provided at both sides of the metal strip path in the third cooling zone. The cooling gas from the gas jets is discharged onto both surfaces of the metal strip for cooling the metal strip to approximately 70° C. to 90° C.

Figure 3:
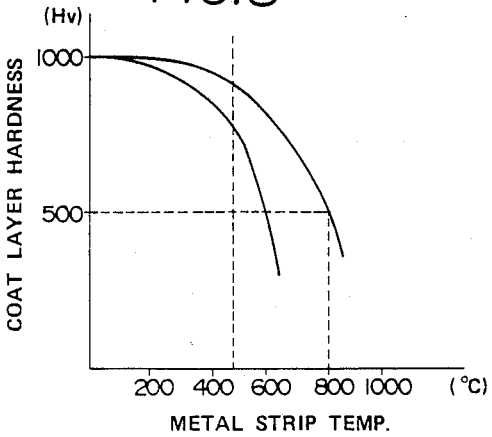
FIG. 3 is a graph showing hardness of surface coating layers of hearth rolls in relation to temperature of a metal strip.
Figure 4:
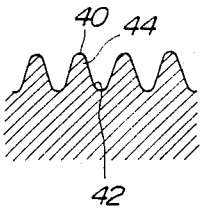
FIG. 4 is a partial section of a surface of a hearth roll which has not been provided a surface coating layer by surface treatment.
Figure 5:
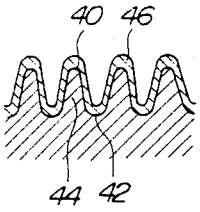
FIG. 5 is a partial section of the surface portion of the surface treated hearth roll.

As will be seen from FIG. 2, in the either cooling mode pattern, the temperature of the metal strip is held lower than the 450° C., above which hardness of the chrome plating layer changes significantly as shown in FIG. 3, in a region adjacent the inlet 40 in the first heating zone and in a downstream half of the second cooling zone 18 and in the third cooling zone. Therefore, a hearth roll 30 which is chrome plated can be used in such regions since the hardness of the chrome plating layer on the peripheral surface of the hearth roll can be maintained at substantially the same level as that of the ceramic coated roll 32.

By employing the chrome plated rolls in the region where the metal strip temperature is held lower than 450° C., cost for constructing the anealing furnace can be significantly reduced since the cost of chrome plated rolls is about one-tenth that of the ceramic coated rolls, such as chromium carbide or tungsten carbide coated rolls. In addition, since with such chrome plated rolls the possibility of welding slag or oxidation scale adhering to the roll is reduced, the possibility of forming pick-up marks on the metal strip can be significantly lowered.

Figure 6:
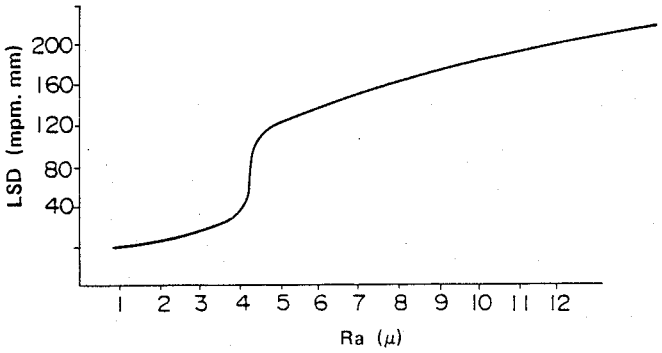
FIG. 6 is a graph showing relationship between LSD value and surface roughness Ra of the hearth roll surface.
Figure 7:
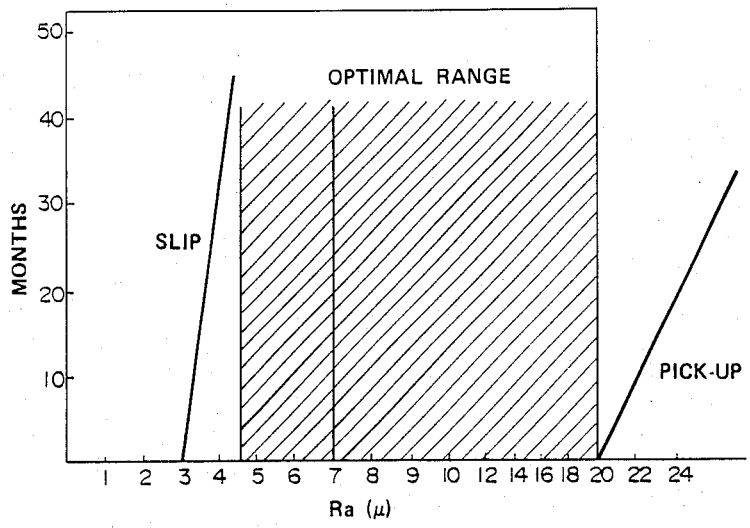
FIG. 7 is a chart showing wear-resistance of the surface treated hearth roll in relation to the surface roughness.
Figure 8:
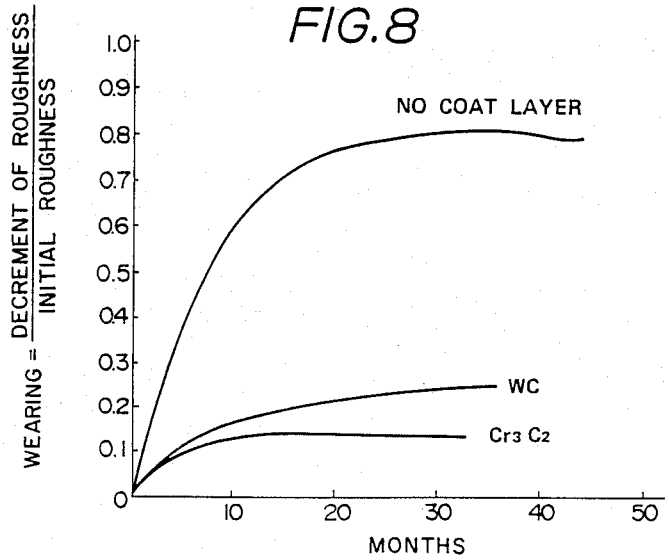
FIG. 8 is a graph showing relationship between wearing rate in relation to life of the hearth roll.

Here, concerning the surface roughness of the hearth roll 30 and 32, the Ra value, which is the height difference between top 40 of the high sections and bottom 42 of the low sections of the uneveness 44 formed on the surface of the roll 30 and 32, should be maintained between 4.5 μm to 20 μm. As seen from FIG. 6, the preferred roughness Ra of the roll surface is variable depending upon the line speed (LSD value) of the metal strip in the annealing furnace. As will be appreciated, higher speed feed can be obtained when the surface roughness (Ra value) is greater than or equal to 4.5 μm. On the other hand, though the greater roughness will allow higher line speed for feeding the metal strip, it creates the problem of causing pick-up marks on the metal strip. This is caused by oxidation scale formed by small amount of $O_2$ contained in the reductive atmosphere. The surface roughness greater than 20 μm substantially increases possibility of formation of oxidation scale and the resulting pick-up marks on the metal strip surface. In view of this, the maximum roughness has been determined to be about 20 μm. When the surface roughness is set in the preferred range, i.e. greater than or equal to 4.5 μm and smaller than or equal to 20 μm the surface coating can be used for a reasonably long time without causing slippage to occur between the roll and metal strip and without forming pick-up marks on the metal surface, as shown in FIG. 6.

Conventionally, the roughness of the hearth roll surface has been obtained by shot blasting utilizing steel shot, super hard metal shot or by laser beam irradiation after surface treatment, such as spray coating of ceramics. As will be appreciated, since the surface coating layer formed by the surface treatment is very hard so as to be resistant to wear, a difficulty is encountered in providing the desired magnitude of roughness on the roll surface. Because of the difficulty of forming unevenness on the roll surface, the magnitude of roughness may be insufficient to prevent slippage between the roll surface and the metal strip, or if the magnitude of roughness is barely sufficient a little bit of wear will cause it to become insufficient unacceptably quickly. Furthermore, due to substantial hardness of the surface layer of the roll, another difficulty is encountered in controlling or adjusting the roughness of the roll surface.

In order to solve such problems in the conventional art, the present invention employs a hearth roll on which the desired roughness or uneveness on the roll surface is provided in advance of the treatment for forming the hard surface layer, such as ceramic spray coating. In order to maintain the desired surface roughness on the roll, the thickness of the coating layer 46 should be in the range of 1 μm to 100 μm.

It will be appreciated that the thicker the surface coating layer the higher the cost. Therefore in the view of cost, a thinner surface layer is preferable. However, if the surface coating layer is thinner than 1 μm, it may soon be worn off especially at the peaks of the high sections this accelerates wear on the roll surface and shortens the life of the hearth roll. On the other hand, when the surface coat layer is of thickness greater than 100 μm, the desired degree of surface roughness cannot be assured.

Therefore, as set forth above, the present invention fulfills all of the objects and advantages sought therefor.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A furnace for heat treatment of a metal strip comprising:

a metal strip path defined within said furnace and extending through a first zone in which a temperature of said metal strip is lower than or equal to a predetermined temperature, a second zone in which a temperature of said metal strip is higher than said predetermined temperature;

a plurality of first hearth rolls having surface roughnesses of at least 4.5 μm disposed along said metal strip path within said first zone, each of said first hearth rolls having its peripheral rough surface plated with a wear-resistant material; and a plurality of second hearth rolls having surface roughnesses of at least 4.5 μm disposed along said metal strip path within said second zone, each of said hearth rolls having its peripheral rough surface spray coated with a wear-resistant material.

2. A furnace for heat treatment as set forth in claim 1, wherein said wear-resistant material forming said plating layer is chrome.

3. A furnace for heat treatment as set forth in claim 1, wherein said metal strip is fed at such a line speed that the product of the line speed and a thickness of the metal strip is greater than 100 (mpm.mm).

4. A furnace for heat treatment as set forth in claim 1, wherein said metal strip path extends through a heating zone, a soaking zone, a first cooling zone, a second cooling zone and a third cooling zone, in which a section adjacent the entrance of said heating zone, the downstream half of said second cooling zone and said third cooling zone constitute said first zone in which said first hearth rolls are disposed.

5. A furnace for heat treatment as set forth in claim 1, wherein the thickness of said wear resistant coating is greater than or equal to 1 μm and less than or equal to 100 μm.

6. A furnace for heat treatment as set forth in claim 1, wherein said wear resistant coating is a spray coated ceramic.

7. A furnace for heat treatment of a metal strip comprising:

a metal strip path defined within said furnace and extending through a first zone in which a temperature of said metal strip is lower than or equal to a predetermined temperature, a second zone in which a temperature of said metal strip is higher than said predetermined temperature;

a plurality of first hearth rolls disposed along said metal strip path within said first zone, each of said first hearth rolls having a multiplicity of ribs extending longitudinally along the peripheral surface thereof, the height of each of said ribs being at least 4.5 μm, said surface and said ribs being plated with a wear-resistant material; and a plurality of second hearth rolls disposed along said metal strip path within said first zone, each of said first hearth rolls having a multiplicity of ribs extending longitudinally along the peripheral surface thereof, the height of each of said ribs being at least 4.5 μm, said surface and said ribs being spray coated with a wear-resistant material.

8. A furnace for heat treatment as set forth in claim 7, wherein said wear-resistant material forming said plating layer is chrome.

9. A furnace for heat treatment as set forth in claim 7, wherein said metal strip is fed at such a line speed that the product of the line speed and a thickness of the metal strip is greater than 100 (mpm.mm).

10. A furnace for heat treatment as set forth in claim 7, wherein said metal strip path extends through a heating zone, a soaking zone, a first cooling zone, a second cooling zone and a third cooling zone, in which a section adjacent the entrance of said heating zone, the downstream half of said second cooling zone and said third cooling zone constitute said first zone in which said first hearth rolls are disposed.

11. A furnace for heat treatment as set forth in claim 7, wherein the thickness of said wear resistant coating is greater than or equal to 1 μm and less than or equal to 100 μm.

12. A furnace for heat treatment as set forth in claim 7, wherein said wear resistant coating is a spray coated ceramic.

13. A furnace for heat treatment of a metal strip comprising:

a metal strip path defined within said furnace and extending through a first zone in which a temperature of said metal strip is lower than or equal to a predetermined temperature, a second zone in which a temperature of said metal strip is higher than said predetermined temperature;

a plurality of first hearth rolls having surface roughnesses of between 4.5 and 20 μm disposed along said metal strip path within said first zone, each of said first hearth rolls having its peripheral rough surface plated with a wear-resistant material;

a plurality of second hearth rolls having surface roughnesses of between 4.5 and 20 μm disposed along said metal strip path within said second zone, each of said hearth rolls having its peripheral rough surface spray coated with a wear-resistant material.

14. A furnace for heat treatment of a metal strip comprising:

a metal strip path defined within said furnace and extending through a first zone in which a temperature of said metal strip is lower than or equal to a predetermined temperature, a second zone in which a temperature of said metal strip is higher than said predetermined temperature;

a plurality of first hearth rolls disposed along said metal strip path within said first zone, each of said first hearth rolls having a multiplicity of ribs extending longitudinally along the peripheral surface thereof, the height of each of said ribs being between 4.5 and 20 μm, said surface and said ribs being plated with a wear-resistant material; and a plurality of second hearth rolls disposed along said metal strip path within said first zone, each of said first hearth rolls having a multiplicity of ribs extending longitudinally along the peripheral surface thereof, the height of each of said ribs being between 4.5 and 20 μm, said surface and said ribs being spray coated with a wear-resistant material.

* * * * *